United States Patent [19]

Mallek et al.

[11] 4,261,269

[45] Apr. 14, 1981

[54] FURNACE FOR INCINERATING WASTE

[75] Inventors: Heinz Mallek, Linnich; Willibald Anger, Jülich, both of Fed. Rep. of Germany

[73] Assignee: Kernforschungsanlage Julich Gesellschaft mit beschrankter Haftung, Jülich, Fed. Rep. of Germany

[21] Appl. No.: 92,986

[22] Filed: Nov. 9, 1979

Related U.S. Application Data

[63] Continuation of Ser. No. 928,810, Jul. 28, 1978, abandoned.

[30] Foreign Application Priority Data

Aug. 4, 1977 [DE] Fed. Rep. of Germany ..... 2735139

[51] Int. Cl.[3] ..... F23G 5/12

[52] U.S. Cl. ..... 110/251; 110/247; 110/255

[58] Field of Search ..... 110/247, 248, 251, 258, 110/278, 297, 255, 346

[56] References Cited

U.S. PATENT DOCUMENTS

| | | | |
|---|---|---|---|
| 1,724,352 | 8/1929 | Ilving | 110/247 |
| 2,402,436 | 6/1946 | Nichols | 110/247 |
| 3,408,968 | 11/1968 | Pantoja | 110/248 X |
| 3,861,332 | 1/1975 | Itasaka | 110/227 |
| 4,048,927 | 9/1977 | Mallek et al. | 110/251 X |
| 4,116,136 | 9/1978 | Mallek et al. | 110/251 |

FOREIGN PATENT DOCUMENTS 249239 2/1966 Austria .

2234095 2/1975 Fed. Rep. of Germany .

*Primary Examiner*—Edward G. Favors

*Attorney, Agent, or Firm*—Frishauf, Holtz, Goodman & Woodward

[57] ABSTRACT

In a furnace in which the waste is loaded into a central shaft at the bottom of which it is held up by a device for letting through small particles after the column of waste has been exposed to degassing and drying heat entering laterally from a smoke chamber. Fresh air is supplied in substoichiometric quantity into the column of waste and is supplied in further quantity through the device for holding up the material in the column as well as just above it and, finally, also in a combustion chamber below the device for afterburning combustible gases. There is an opening between the device for holding up the waste material in the shaft and the inner wall of the shaft to material to form an inclined layer down to the hole at the bottom of the shaft, enclosing a combustion space. An ember bed forms here, from which melted material passes down through a combustion chamber below and through a drain in the floor of the combustion chamber. Gases evolved in the shaft are sucked down through the same opening into the combustion chamber for completion of combustion and development of heat in the lateral smoke chamber through they pass in the process of being exhausted after suitable filtering. Tubular ducts are provided in the shaft for supply of additional fresh air or, if needed, in starting up, for example, of a fuel gas. With waste of the usual composition, the combustion process will run without the addition of heat from an external source.

6 Claims, 3 Drawing Figures

FURNACE FOR INCINERATING WASTE

This is a continuation, of application Ser. No. 928,810 filed July 28, 1978, now abandoned.

This invention concerns a furnace for burning waste material having a central shaft, provided for introduction of the material, into which fresh air supply conduits lead, and having below the shaft a combustion chamber itself provided with fresh air channels in its portion immediately adjacent the shaft and, also, having a device for holding up waste material, located in the shaft, of such a design that the waste material of the column thereby formed falls through as loose material, the combustion chamber having a smoke-withdrawal portion connected by flues to a smoke-withdrawing structure.

A furnace of this kind is disclosed in British U.K. Pat. No. 1,365,125. In this known furnace, the device for holding up the waste material is constituted as grate. Devices are also provided through which fresh air is supplied from below through the grate into the column of waste material. The gases formed and given off in the waste material column, along with the fresh air additionally introduced into the waste material column, are sucked upwardly and led to separate apparatus for treatment or preparation of the evolved gases and are only thereafter used for combustion of the waste material. This constitution of the known furnace does not make it possible to control the combustion of the waste material in such a way that the heat energy contained in the waste material will suffice for the burning of waste of normal composition and for melting of the slag residues. Instead, it is necessary in the case of this known equipment to utilize burners additionally provided in the walls of the combustion chamber, by which extraneous fuel is supplied to the combustion chamber, in order to thus be able to reach the temperature required for melting of the slag residues.

It is an object of the present invention to provide a furnace with which it is possible to burn up waste material of the usual composition with a heat content of 3,000 kcal/kg without the introduction of supplementary fuel in a simple process and, at the same time, to obtain the residues as melts. The process should also be easily and securely controlled, even in the burning of waste of heterogeneous composition.

SUMMARY OF THE INVENTION

Briefly, a furnace of the above-mentioned kind is improved in accordance with the invention by the provision of the following combination of features:

(a) the floor of said shaft has its deepest place centrally located and is there provided with at least one opening;

(b) said device for holding waste material up in said shaft is located in the lower portion of said shaft and so constituted that there remains, for passage of waste material and of evolved gases produced in drying, degassing and gasification, only a small number of openings located between said device and the inner wall of said shaft, the aggregate cross-section of said openings, and their spacing from the bottom of said shaft being so dimensioned that said loose material passed downwards tends to fill up space extending from said last-mentioned openings down to said central opening at the bottom of said shaft and alongside thereto a combustion space is formed located between said device and the bottom of said shaft that is laterally bounded by waste material to be burned;

(c) fresh air supply channels are provided in said device leading into said combustion space;

(d) additional fresh air supply channels lead into said shaft above said remaining openings between said device and said inner wall of said shaft;

(e) the fresh air supply channels provided in said combustion chamber have their mouths in the vicinity of said centrally located opening in the shaft floor; and (f) said combustion chamber is constituted as a chamber with laterally disposed exit flues for the smoke gases and at least one drain for melted material in the floor of the chamber.

Below the combustion chamber, there is fitted a a container for receiving the slags or melts. This container can occasionally be filled with water in order to obtain the immediate solidification of the melts that have been picked up in the container, after which the residue can be converted into granular material.

With a furnace in accordance with the invention, the waste material is first heated in the upper part of the central shaft while air is excluded, which produces a drying and degassing of the waste material and thereby a thermal heat decomposition of the waste material. In order to obtain this result in the most economical way, exhaust flues for smoke gases lead into a smoke-withdrawal space that surrounds the central shaft. The waste heat of the exothermic combustion process taking place in the lower part of the shaft as well as in the combustion chamber is thereby supplied over short heat conduction paths to the waste material located in the shaft for carrying out the endothermic drying and degassing. By drawing off the evolved gases downwardly, the low-temperature carbonization gases produced by drying and degassing are also carried along in the direction of the increasing temperature gradient. This has the consequence that these organic gases are cracked in the increasing heat into short-chain hydrocarbon molecules, which are then easily and completely burned in the following combustion step without leaving tar-containing residues.

By means of the fresh air conduits opening into the central shaft of the device for holding up the waste material therein, fresh air is supplied to the waste material in substoichiometric ratio, and at this stage, if desired; for example, when the waste material does not contain sufficient moisture or there is present a waste material that is particularly difficult to burn; water vapor or water can be added to the fresh air, in order thus to bring about the desired water-gas reaction for production of combustible gases. Since the gases thus evolved are drawn downwardly through the openings, between the device for holding or stacking the waste material and inner wall of the shaft, a glowing ember bed is formed between the fresh air supply ducts above the just-mentioned openings and the device for holding up the material, in which glowing ember bed the exothermic process of combustion takes place and, also, reinforced by the exothermic process, the endothermic process of degassing and especially degassification of the waste material. In this manner, on the one hand, there is obtained a volume reduction and embrittlement of the waste material, which facilitates the passing of the material through the openings left around the device for holding up the waste material in the shaft. On the other hand, as a result of the processes taking place in the ember bed, a coking of the waste material is obtained and the material is thus converted into a homogeneous form.

The combustible evolved gases, because they are sucked downwards, pass through the downwardly proceeding coked waste material into the combustion chamber below the device for holding up the waste material and mix in the combustion chamber with the fresh air introduced therein over or through that device in nearly stoichiometric quantity ratio. In this process, particularly at the surface of the loose layer of material, at which the combustible gases come into contact with the fresh air, temperatures in the region of about 1,500° C. are obtained, which lead to melting of the uncombustible residues. The downwardly flowing melt thereby proceeds through the opening located in the shaft floor and thence through the drain of the combustion chamber below, into a container provided for receiving the melt.

For afterburning of the gases getting into the combustion chamber through the opening in the floor of the shaft, fresh air is introduced into the combustion chamber through fresh air conduits provided in the region of this opening in the floor of the shaft, whereby in addition to the afterburning of the gases, a cooling of the effluent gases is obtained.

For the case in which waste of high-caloric content, or on the other hand, of waste material difficult to burn, is to be consumed, it can be of advantage to provide tubular conduits extending from the exterior into the shaft, above the device for holding up the waste material, connectible to a suction device or to a fuel gas supply. Thus, for better control of the combustion process, the possibility is additionally provided to change the quantity of substoichiometrically and of approximately stoichiometrically supplied fresh air, or, selectively, to suck off excess fuel gas or to feed fuel gas.

An advantageous elaboration of the furnace of the invention consists in provision of the device for holding up the waste material as a unit mounted on an axle and movable by a manual grip or by a power drive. By the movement of this unit, it is possible to operate on the embrittled waste material located on the region of the ember bed and to obtain a reduction in the particle size of this material so that a loose layer without gaps or voids can be produced in the combustion chamber.

The invention is further described by way of illustrative examples with reference to the annexed drawings, in which.

Figure 1:
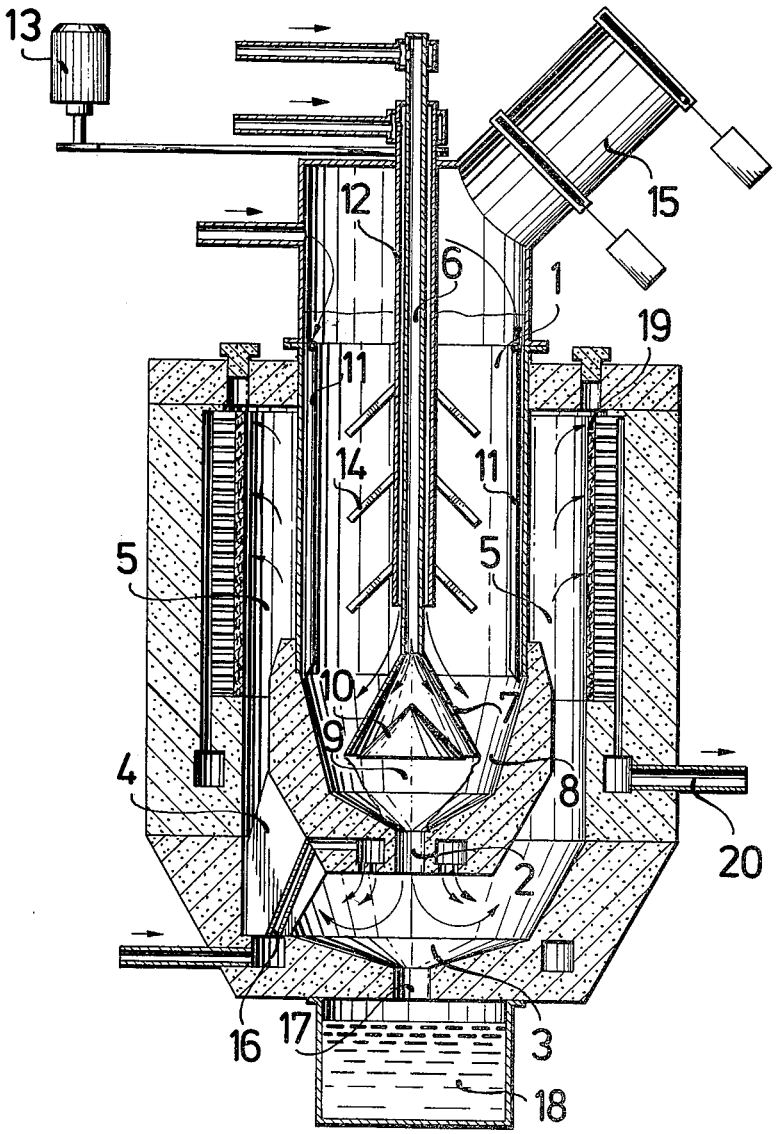
FIG. 1 is a diagramatic vertical cross-section of a furnace of combustion of waste in a round or cylindrical form.

As shown in FIG. 1, a cylindrical central shaft 1 is provided for receiving and introducing the waste material. The lower portion of the shaft consists of a conically shaped furnace muffle, at the deepest portion of which a central opening 2 is provided. The furnace muffle, which is adjacent to a combustion chamber 3 below, is supported on several supports 4, of which only one is represented, however, in FIG. 1. The combustion chamber 3 is connected with the suction space 5 for the smoke gases which is constituted as an annular chamber surrounding the central shaft.

A centrally disposed tube 6 extends from above into the shaft 1 and widens at its lower end into a conical part 7. This part 7 serves for holding up or backing the waste material located in the upper and middle portions of the central shaft and, at the same time, however, also for subdivision of the waste material into loose mass. As a result of the circular construction shape of the oven, the opening 8 provided between the device 7 for holding up the waste material and the inner wall of the shaft 1 has the form of an annular opening. The waste material proceeds from this opening in a loose mass inwardly directed which laterally surrounds the combustion space 9. In the portion 7, a cone 10 is so disposed that it forms with the part 7 a slit at the lower end of the latter, which makes possible the supply of fresh air through the tube 6 into combustion space 9. For the supply of fresh air into the waste material, above the region of the annular opening 8, additional tubes 11 are provided along the inner wall of the shaft and also a tube 12 coaxially surrounding the tube 6. Both the tube 11 and the tube 12 are—as not, however, shown in the drawing—also connectable to an external fuel gas supply or likewise to a conduit supplying water vapor. The tube 12 is, furthermore, mounted rotatably and can be rotated by drive 13. Because rod-shaped parts 14 extending into the shaft are also attached, it is also possible to set the material in the waste material column into motion, and thereby to shift it about, by rotation of the tube 12.

During operation of the furnace, the waste material is loaded by means of a transfer box 15 into the central shaft 1 to a height which corresponds about to the height of lightly drawn line 1*a* indicating the top of a filling of waste material in the shaft. In the upper and middle portions of the shaft, the waste is dried and degassed by the heat-penetrating from the smoke-drawing space 5 into the column of waste material. After the supply of fresh air through the tubes 11 and 12 (the connections of the tubes 11 to the fresh air supply are not actually shown but are symbolized by the arrows 11*a*), a volume reduction of the waste material as the result of degassing, and size reduction of the pieces as the result of embrittlement of the material, take place in the region directly above the component 7 that holds the material up in the shaft. In the combustion space 9, in which temperatures in the region of about 1,500° C. are reached, the waste material is finally burned up and the incombustible residues are melted. The gases coming out of the opening 2 of the bottom of the shaft into the combustion chamber 3 are then afterburned, with additional fresh air being supplied through the duct 16 running in the support 4 and the furnace muffle.

While the melt drops through the opening 2 and then the drain 17 in the bottom of combustion chamber 3 to land in a container 18, the smoke gases are conducted through the smoke-drawing space 5 and through the filter 19 to the gas exhaust duct 20, during which procedure the solid particles suspended in the smoke gases collect in a layer on the filters and are also burned out by the oxygen still present there in the hot gases. The filter can, therefore, for example, be made of perforated ceramic plates with mats of ceramic fibers on the side of the arriving gases.

Figure 2:
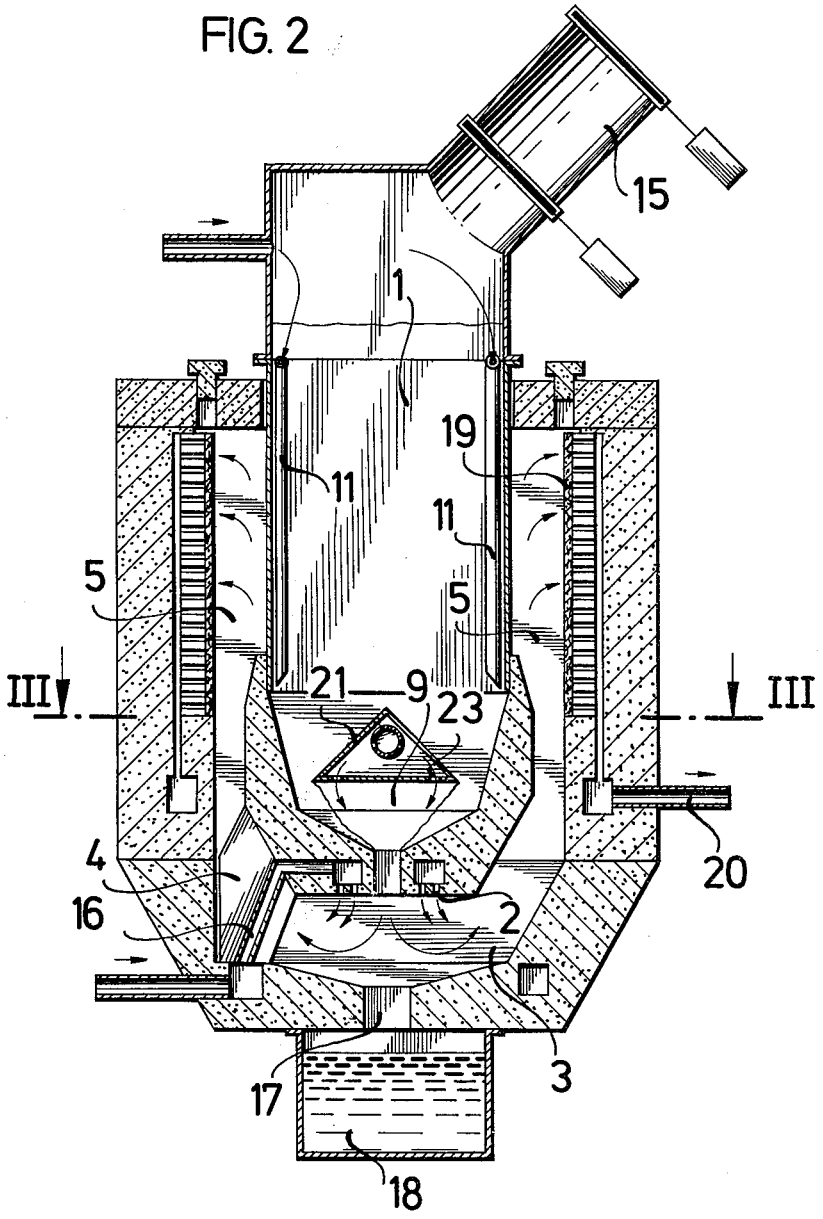
FIG. 2 is a diagramatic vertical cross-section of a furnace for combustion of waste of rectangular construction form.
Figure 3:
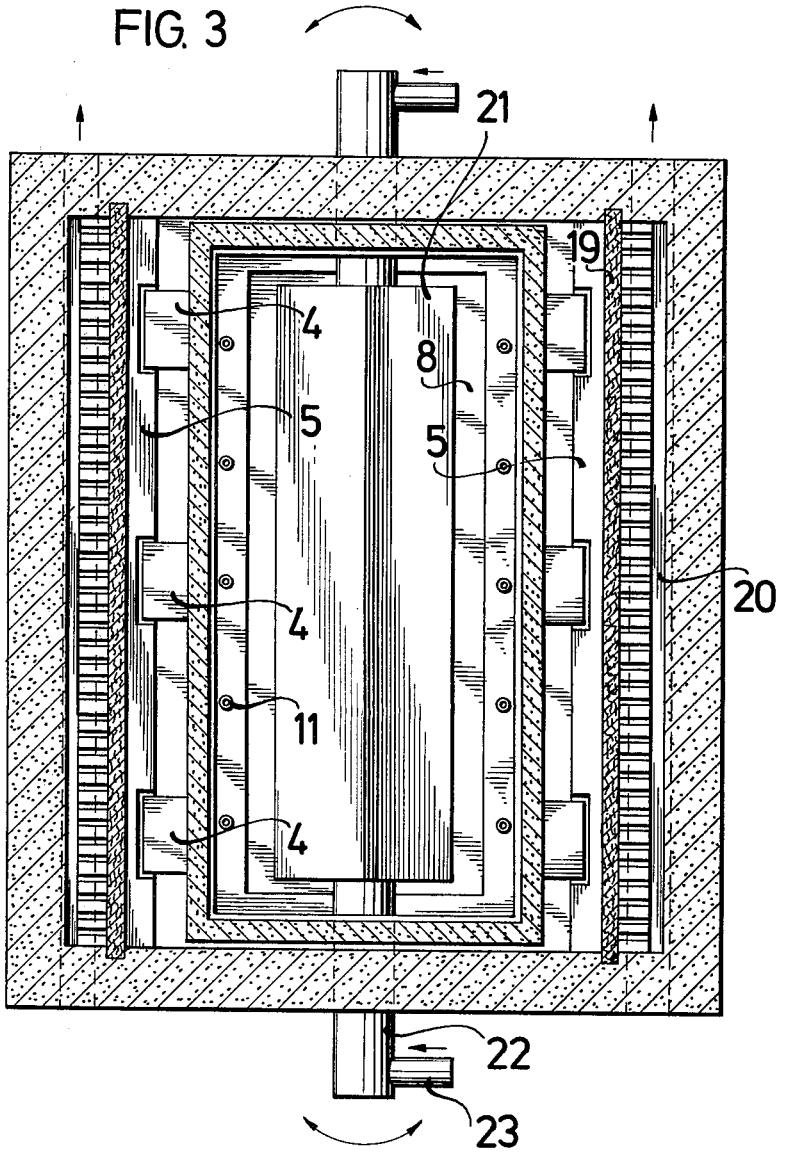
FIG. 3 is a horizontal cross-section through the furnace of FIG. 2 along the line A–B.

FIG. 2 shows another form of furnace according to the present invention. This variant differs from the form of construction of FIG. 1 not only by the rectangular plan, but also in that the device for holding up the waste material constituted as a sluice component 21 having a triangular cross-section. This sluice component 21 is, as is clear from FIG. 3, mounted so as to be able to be swung by about 15° about an axle 22. Conduits 23 passing by way of the axle 22 into the sluice element serve for supply of fresh air into the combustion space 9.

Since waste combustion furnaces according to the invention provide a compacting operation, the noncombustible residue is present as melted ash and is therefore very resistant to lixiviation or leaching out, while at the same time the suspended solid particles entrained in the smoke gases are held back by filters, so that the furnace of the present invention is usable not only for normal garbage or clinical waste, but also for radioactively contaminated material.

Although the invention has been described with reference to particular illustrative examples, it will be evident that variations and modifications are possible within the inventive concept.

We claim:

1. A furnace for burning waste material having a central shaft for introduction of waste material and provided with fresh air supply channels, and having a combustion chamber disposed below said central shaft itself provided with fresh air supply channels, in its portion immediately adjacent to said shift, and also having a device for holding up waste material located in said shaft of such a design that the column of waste material thereby formed falls through as loose material, said combustion chamber having a smoke withdrawal portion connected by flues to said smoke-withdrawing structure, said furnace having the improvement which consists in the combination of the following features:

(a) the floor of said shaft (1) has its deepest place centrally located and is there provided with at least one opening (2) leading downward to said combustion chamber (3);

(b) said device (7) for holding waste material up in said shaft is located in the lower portion of said shaft and so constituted that there remains for passage of waste material and of evolved gases produced in drying, degassing and gasification only an annular opening (8) located between said device and the inner wall of said shaft, the aggregate cross-section of said annular opening (8), and its spacing from the bottom of said shaft being so dimensioned that said loose material passed downwards tends to fill up space extending from said annular opening (8) down to said central opening (2) at the bottom of said shaft (1) while leaving free a combustion space (9) formed and located between said device (7) and the bottom of said shaft, which combustion space is laterally bounded by loose waste material to be burned with aid from the combustion of said evolved gases;

(c) a fresh air supply channel (6) is provided in said device leading into said combustion space (9);

(d) said evolved gases are required to pass along with said waste material through said central opening (2) at the bottom of said shaft before the gaseous combustion products formed are withdrawn by way of said smoke withdrawal portions (5) of said combustion chamber (3) and said flues;

(e) additional fresh air supply channels (11, 12) lead into said shaft (1) above said annular opening (8);

(f) a second set of fresh air supply channels (16) is provided in said combustion chamber (3) and have their mouths in the vicinity of said centrally located opening (2) in the shaft floor; and (g) said combustion chamber (3) is constituted as a chamber with laterally disposed exit flues for the smoke gases and at least one drain (17) for melted material in the floor of the chamber.

2. A furnace as defined in claim 1 in which a smoke removal space (5) that surrounds said central shaft is provided into which said flues for the smoke gas lead.

3. A furnace as defined in claim 2 in which tubular conduits are provided extending into said central shaft (1) having their mouths above said device (7) holding up waste material in said central shaft, said tubular conduit being connectable selectively to exhaust suction means or to combustion gas or air supply means.

4. A furnace as defined in any of claims 1–3 in which said device (7) for holding up material in said shaft is constituted as a unit (21) mounted on an axle (22) about which it is rotatably movable.

5. A furnace as defined in any of claims 1–3 in which said device (7) for holding up material in said shaft is constituted as a unit (21) mounted on an axle (22) about which it is rotatably movable in response to a manual operating means.

6. A furnace as defined in any of claims 1–3 in which said device (7) for holding up material in said shaft is constituted as a unit (21) mounted on an axle (22) about which it is rotatably movable in response, selectively, to a manual or a power-driven operating means.

* * * * *